US006550291B2

(12) United States Patent
Uhlin et al.

(10) Patent No.: US 6,550,291 B2
(45) Date of Patent: Apr. 22, 2003

(54) SAFETY DEVICE FOR A LAUNDRY WASHING MACHINE

(75) Inventors: Göran Uhlin, Lagan (SE); Sten Håkan Almström, Ljungby (SE)

(73) Assignee: Aktiebolaget Electrolux, Stockholm (SE)

( * ) Notice: Subject to any disclaimer, the term of this patent is extended or adjusted under 35 U.S.C. 154(b) by 48 days.

(21) Appl. No.: 09/881,156

(22) Filed: Jun. 14, 2001

(65) Prior Publication Data

US 2001/0052250 A1 Dec. 20, 2001

(30) Foreign Application Priority Data

Jun. 15, 2000 (SE) ..... 0002241

(51) Int. Cl.[7] ..... D06B 37/42
(52) U.S. Cl. ..... 68/12.26; 68/5 C
(58) Field of Search ..... 68/5 C, 5 D, 13 R, 68/12.26; 220/316

(56) References Cited

U.S. PATENT DOCUMENTS

| | | | | |
|---|---|---|---|---|
| 1,849,283 | A | * | 3/1932 | Crane |
| 2,399,327 | A | * | 4/1946 | Cullen |
| 2,708,293 | A | * | 5/1955 | Sherman |
| 2,718,239 | A | * | 9/1955 | Erbguth |
| 3,011,327 | A | * | 12/1961 | Brownell |
| 3,107,810 | A | * | 10/1963 | King |
| 3,235,124 | A | * | 2/1966 | Kuever |
| 3,661,409 | A | * | 5/1972 | Brown et al. |
| 3,744,402 | A | * | 7/1973 | Piegza et al. |
| 3,907,157 | A | * | 9/1975 | Beattie |
| 3,924,778 | A | * | 12/1975 | Sorensen |
| 4,139,118 | A | * | 2/1979 | Parker |
| 4,515,287 | A | * | 5/1985 | Baudoux et al. |
| 4,746,030 | A | * | 5/1988 | Gabriele |
| 5,267,455 | A | | 12/1993 | Dewees |
| 5,918,756 | A | * | 7/1999 | Morgan |
| 6,053,541 | A | * | 4/2000 | Harris |

FOREIGN PATENT DOCUMENTS

| | | | |
|---|---|---|---|
| DE | 3116961 | * | 11/1982 |
| FR | 2381126 | * | 10/1978 |
| GB | 1243376 | * | 10/1969 |
| GB | 2 178 504 | | 6/1986 |
| GB | 2304799 | * | 3/1997 |
| JP | 5-196197 | * | 8/1993 |

* cited by examiner

*Primary Examiner*—Frankie L. Stinson
(74) *Attorney, Agent, or Firm*—Pearne & Gordon LLP

(57) ABSTRACT

A safety device for a laundry washing machine or the like where the washing machine comprises a treatment chamber (12) for laundry that is pressurized in order to treat the laundry with a treating agent, for instance, carbon dioxide. The treatment chamber has an inlet opening (13) which during the treatment is covered by a door (16) that is secured to a housing (11) enclosing the chamber by means of a first holder device (35) which is part of a locking means. The locking means also comprises a second holder device (34) which is activated if the first holder device (35) is deactivated and thereby keeps the door (16) in its closed position as long as chamber is pressurized.

9 Claims, 3 Drawing Sheets

SAFETY DEVICE FOR A LAUNDRY WASHING MACHINE

BACKGROUND OF THE INVENTION

This invention relates to a safety device for a laundry washing machine or the like which has a treatment chamber with an inlet opening for laundry that is pressurized in order to treat the laundry with a treating agent, for instance, carbon dioxide. During treatment, the inlet opening of the chamber is covered by a door that is secured to a housing surrounding the chamber by a locking device.

Washing machines of the type described above are previously known and have been developed because of environmental reasons in order to replace chemical washing methods where, for instance, trichloroethylene or perchloroethylene are used. When these alternative machines use, for instance, liquid carbon dioxide, however, there is a complication with respect to the technique being used since the treatment chamber has to be under pressure during the treatment procedure. Machines of this type are described in, for instance, U.S. Pat. No. 5,267,455. Thus, it is necessary to prevent the door from being opened when the treatment chamber is pressurized since an unintentional opening of the door in this state could cause personal injuries as well as damages on property.

BRIEF SUMMARY OF THE INVENTION

This invention provides a simple device by which the washing machine door is locked and is prevented from being opened as long as the pressure prevails in the treatment chamber, even if for any reason the locking mechanism would not work properly, for instance, because of malfunctions in the system controlling the opening and closing of the door.

This is achieved by an apparatus having a locking means that has a first holder device which secures a door to a housing surrounding the chamber and a second holder device which is activated if the first holder device is deactivated, thereby keeping the door in its closed position as long as the chamber is pressurized.

DETAILED DESCRIPTION OF THE INVENTION

Figure 1:
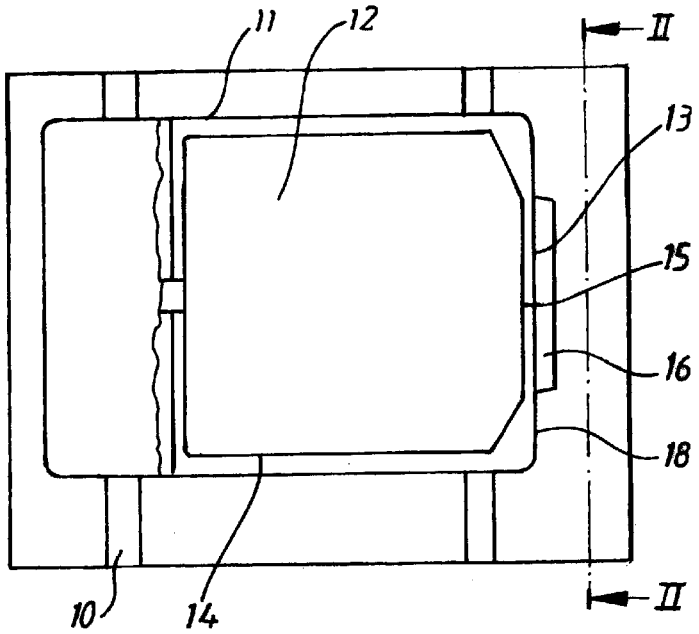
FIG. 1. schematically shows a section through the laundry washing machine where the invention is used.
Figure 2:
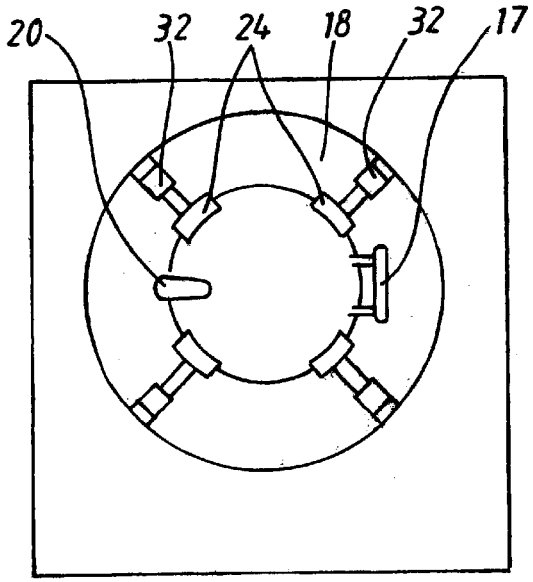
FIG. 2 is a schematic front view of the same laundry washing machine in FIG. 5.

An embodiment of the invention will now be described with reference to the accompanying drawings. The laundry washing machine as shown in FIGS. 1–2 comprises a frame 10 supporting a pressure safe housing 11 forming a chamber 12 having an inlet opening 13. The chamber 12 encloses a drum 14 which is rotatably arranged by means of a horizontal shaft which extends through a rear wall of the chamber 12 and, which is driven by an electric motor (not shown). The drum 14 in a conventional manner has an opening 15 which is approximately as large as the inlet opening 13 and is coaxial with it. During the washing process, the inlet opening 13 is covered by a door 16 which by hinges 17 are fastened to the front wall 18 of the housing 11. The door is sealed from the housing by means of a resilient sealing member 19, a gasket or the like, and the machine is provided with a manually or automatically operating locking device 20 and by which the door is closed.

Figure 3:
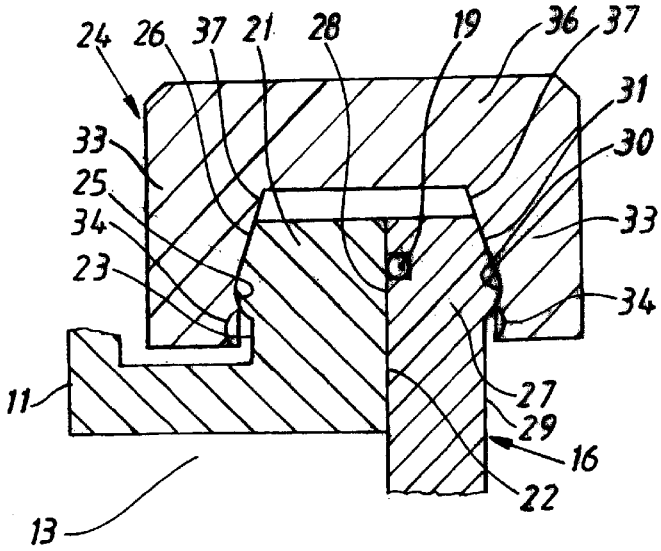
FIG. 3. is a section through an embodiment of the safety device in a normal locked position.

As shown in FIG. 3, the housing 11 is provided with one or several flange parts 21 at the front wall 18 which are directed outwardly with respect to the plane of the opening and which completely or partly surround the inlet opening 13. These flange parts 21 are provided with a first side 22 which the sealing 19 abuts and a second side 23 cooperating with an U-shaped profile 24 being a part of the locking means. This second side 23 is provided with a bead 25 extending in the length direction of the flange part and continuing into an outer slanted surface 26.

The door has an edge part 27 which is substantially parallel to said flange part 21. One side 28 of the edge part has a groove in which the sealing 19 is fastened, whereas the second side 29 of the edge part in a corresponding way as the flange part 21 is provided with a bead 30 continuing into a slanted surface 31. The second side 29 cooperates with the U-shaped profile 24.

As shown in FIG. 2, the locking device 20 comprises several of the U-shaped profiles 24 which are placed about the periphery of the door. The profiles 24, which have a suitable length with respect to the loads that are to be taken up, are each supported on the piston rods of hydraulic or pneumatic cylinders 32. The hydraulic or pneumatic cylinders 32 are positioned at the front wall 18 of the housing 11 and are connected to the control circuit (not shown) of the washing machine. Thus, the profiles 24 can be moved toward the center of the door by means of hydraulic or pneumatic means.

The profiles 24 may also be mechanically operated for instance, by an iris which means that the movement of the profiles are compulsory depending on one another.

Figure 4:
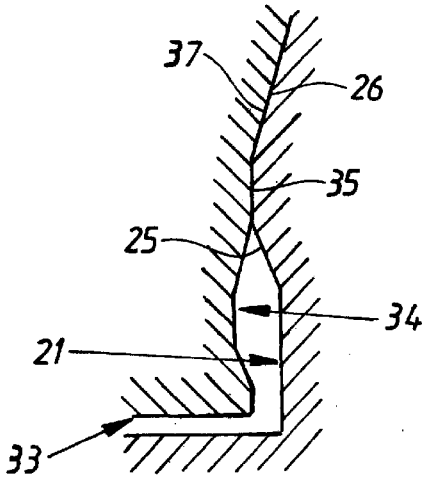
FIG. 4 shows a detailed enlargement of the section shown in FIG. 3.

Referring to FIGS. 3–4, the U-shaped profile 24 of the locking means has two substantially parallel legs 33 and whose opposite insides have approximately the same design. Each leg has a recess 34 placed close to the outer parts of the leg and these recesses have a design corresponding to the design of the beads 25, 30. Each leg is also provided with a plane surface 35 placed between the recess 34 and the waist part 36 of the profile and the plane surfaces 35 are substantially parallel. The plane surfaces 35 continue into slanted surfaces 37 forming the inner parts of the legs and which continue into the waist part 36.

The device normally operates in the following way; see FIGS. 1–4. Laundry is filled through the inlet opening 13 into the drum 14, after which the door is manually closed and locked by the locking device 20. Then, the control circuit of the machine is activated. The piston rods of the hydraulic cylinders 32 move the U-shaped profiles 24 toward the flange parts 21 and the edge part 27 of the door causing these parts to successively press against one another since the slanted surfaces 26, 31 engage the outer parts of the legs 33. During the further movement of the profiles 24, the beads 25, 30 will pass the recesses 34 in the legs 33 and climb up on the plane surfaces 35 at the same time the sealing 19 is compressed. Thus, the door is locked and sealed with respect to the housing 11.

Then, a cleaning agent, for instance, liquid carbon dioxide, is allowed to enter the chamber 12, which means that the chamber will be pressurized. During the treatment, the drum 14 is rotated and when the treatment is finished, the treatment agent is removed and the pressure is unloaded. When the pressure has been reduced to atmospheric level, the profiles 24 are moved outwards by the hydraulic cylinders so that the profiles are released from the flange parts and the edge part of the door and the door can be opened when the locking means 20 has been released.

If any malfunction occurs in the control system during treatment when the chamber is pressurized such that the U-shaped profiles 24 move outward (see FIGS. 5–6), the beads 25, 30 fall into the recesses 34 at the same time as the door is moved somewhat from the housing because of the prevailing pressure in the chamber 14 against the door 16. This means that the door 16 is locked in this position until the pressure in the chamber 12 is reduced to a level where the door can be opened safely. In order to open the door from this safety position, the door has to move against the direction of the forces influencing the door, a need for forces from the cylinders 32 which they are not designed for.

Figure 5:
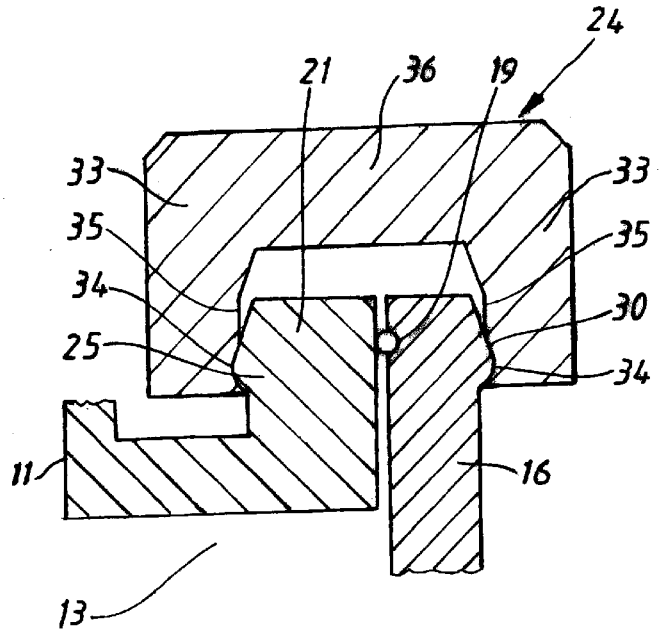
FIG. 5 is a section through the safety device in a position where the door has been blocked because of some kind of malfunction.
Figure 6:
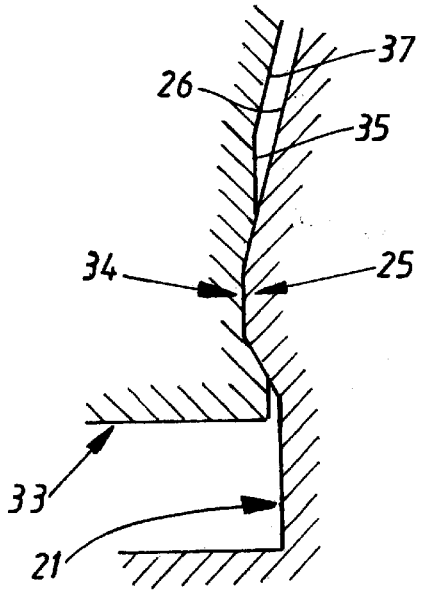
FIG. 6 is a detailed enlargement of the section shown in FIG. 5.

It is also possible to unload the pressure automatically in the chamber 12 by designing the sealing 19 in such a manner that a certain leakage occurs when the locking device is in the safety position, i.e., when the door has been removed from the housing to the position shown in FIG. 5. Thus, the gas in the treatment chamber will flow out such that the door is unloaded.

While the invention has been described with reference to a specific embodiment, various changes may be made and equivalents may be substituted for elements thereof by those skilled in the art without departing from the scope of the invention. In addition, other modifications may be made to adapt a particular situation or method to the teachings of the invention without departing from the essential scope thereof. The present invention herein is not to be construed as being limited, except insofar as indicated in the appended claims.

What is claimed is:

1. A safety device for a laundry machine comprising a treatment chamber (12) for laundry with an inlet opening (13) which during the treatment is covered by a door (16) which is secured to a housing (11) surrounding the chamber by a first holder means (35) being a part of a locking means, the chamber (12) being pressurized in order to treat the laundry with a treating agent, characterized in that the locking means also comprises a second holder means (34) which is activated if the first holder means (35) is deactivated and thereby keeps the door (16) in its closed position as long as the chamber (12) is pressurized, wherein the first and the second holder means (35 and 34) are integrated in a common unit (24).

2. A device according to claim 1, characterized in that the common unit (24) is a substantially U-shaped profile with a first leg and a second leg (33) that engage the door (16) and means arranged on the housing.

3. A device according to claim 2, characterized in that the housing (11) comprises, with respect to the plane of the opening, an outwardly extending flange part (21) which at least partly surrounds the opening, wherein the door (16) is provided with an edge part (27) which is substantially parallel to said flange part (21) and the U-shaped profile (24) engages the flange part (21) or the edge part (27) with at least one leg (33).

4. A device according to claim 3, characterized in that at least the flange part (21) or the edge part (27) is provided with a bead (25, 30) abutting one leg (33) of the U-shaped profile (24) and engaging a recess (34) arranged in the one leg (33).

5. A device according to claim 4, characterized in that the legs (33) of the U-shaped profile (24) are provided with opposite, substantially parallel surfaces (35) arranged in association with the recesses (34) and are closer to the waist part (36) of the U profile than the recesses (34).

6. A device according to claim 3 characterized in that the legs (33) of the U-shaped profile as well as the edge part (27) of the door and the flange part (21) of the housing are provided with cooperating slanted surfaces (26, 31, 37) which when the U-shaped profile (24) is moved towards the center of the door presses the door (16) against the flange part (21) of the housing.

7. A device according to claim 6 characterized in that a resilient means (19) is arranged between the door (16) and the housing (11).

8. A device according to claim 7 characterized in that the resilient means (19) is a gasket.

9. A device according to claim 8 characterized in that the door (16) is moved outwards from the housing (11) by the pressure prevailing in the chamber (12) when the second holder means (34) has been activated.

* * * * *